US008777819B1

(12) United States Patent
Quintana

(10) Patent No.: US 8,777,819 B1
(45) Date of Patent: Jul. 15, 2014

(54) BOXING TRAINING SYSTEM

(76) Inventor: Kelvin Quintana, Canovanas, PR (US)

( * ) Notice: Subject to any disclaimer, the term of this patent is extended or adjusted under 35 U.S.C. 154(b) by 431 days.

(21) Appl. No.: 13/157,995

(22) Filed: Jun. 10, 2011

Related U.S. Application Data

(60) Provisional application No. 61/397,641, filed on Jun. 15, 2010.

(51) Int. Cl.
*A63B 69/22* (2006.01)
*A63B 69/24* (2006.01)

(52) U.S. Cl.
USPC ..... 482/87; 482/83

(58) Field of Classification Search
USPC ..... 482/4, 7, 83–87, 89; 198/340, 198/341.08–341.09, 465.4; 105/141, 148, 105/150, 156
See application file for complete search history.

(56) References Cited

U.S. PATENT DOCUMENTS

| | | | | |
|---|---|---|---|---|
| 3,424,458 | A | 1/1969 | Hopps | |
| 3,447,074 | A * | 5/1969 | Sower et al. | 324/261 |
| 3,547,438 | A | 12/1970 | Schmitter | |
| 3,637,210 | A | 1/1972 | Brantley | |
| 4,246,848 | A * | 1/1981 | Schneider | 104/173.2 |
| 4,274,783 | A * | 6/1981 | Eineichner et al. | 198/349.95 |
| 4,453,303 | A * | 6/1984 | Leddet | 29/407.05 |
| 4,953,852 | A * | 9/1990 | Donohue | 482/87 |
| 4,982,827 | A * | 1/1991 | Seitz et al. | 198/341.07 |
| 5,048,822 | A | 9/1991 | Murphy | |
| 5,061,148 | A * | 10/1991 | Petz | 414/564 |
| 5,096,245 | A * | 3/1992 | Kikuchi et al. | 294/87.1 |
| 5,224,912 | A | 7/1993 | Moody | |
| 5,503,606 | A | 4/1996 | Stephens | |
| 5,509,875 | A * | 4/1996 | Moretti | 482/90 |
| 5,647,747 | A * | 7/1997 | Macri et al. | 434/247 |
| 5,803,877 | A | 9/1998 | Franey | |
| 5,819,906 | A * | 10/1998 | Enderlein et al. | 198/687.1 |
| 5,844,240 | A | 12/1998 | Lee et al. | |
| 5,897,466 | A | 4/1999 | Capach | |
| 6,065,482 | A * | 5/2000 | Parslow, Jr. | 134/56 R |
| 6,220,992 | B1 | 4/2001 | Shafik | |
| 6,530,867 | B2 | 3/2003 | Schwendemann | |
| 6,758,794 | B2 | 7/2004 | Lee | |
| 7,736,248 | B2 * | 6/2010 | Eldridge | 473/445 |
| 7,789,811 | B2 | 9/2010 | Cooper | |
| 2003/0146069 | A1 * | 8/2003 | Kaiser | 198/465.4 |
| 2008/0035448 | A1 * | 2/2008 | Boberg et al. | 198/341.08 |
| 2008/0149458 | A1 * | 6/2008 | Ehlert | 198/340 |
| 2010/0089722 | A1 * | 4/2010 | Wiedemann et al. | 198/465.4 |

* cited by examiner

*Primary Examiner* — Stephen Crow
*Assistant Examiner* — Garrett Atkinson
(74) *Attorney, Agent, or Firm* — Luis Figarella

(57) ABSTRACT

A simulated sparring partner apparatus and method for the training and exercising of a boxer, including a variable path and height track, a target article such as a punching bag or boxing pear suspended from the track, one or more drives for moving the target article along the track, and a control apparatus for controlling the speed and direction of movement of the carriage along the track. The drive may move the punching bag at various speeds and in either direction, either on its own, or as a result of the boxer's actions. Also, the drive may be programmable such that the carriage follows a predetermined path at predetermined speeds.

3 Claims, 11 Drawing Sheets

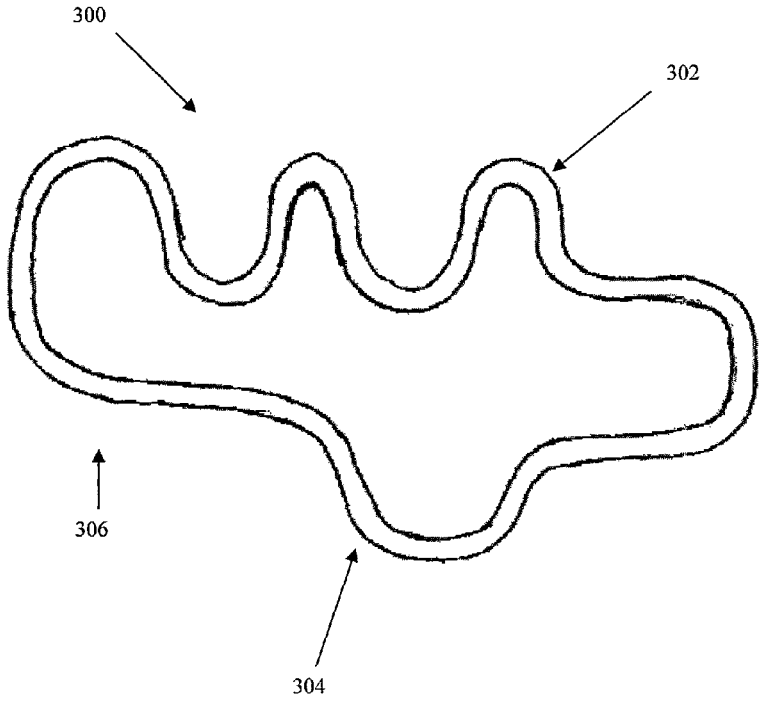
Figure 3A
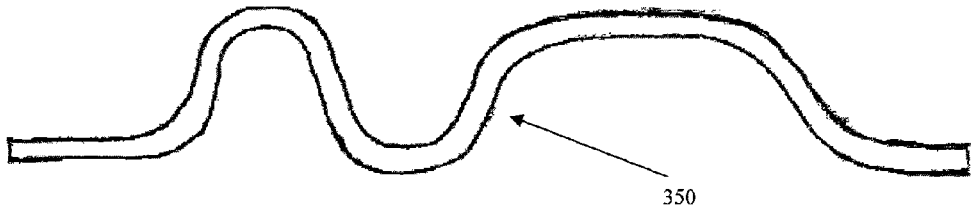
Figure 3B
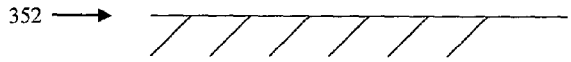

BOXING TRAINING SYSTEM

CROSS-REFERENCE TO RELATED APPLICATIONS

This application claims priority to U.S. provisional patent application Ser. No. 61/397,641 titled "Sliding system of punching bag" filed on Jun. 15, 2010, the disclosure of which is herein incorporated by reference in its entirety.

PATENTS CITED

The following documents and references are incorporated by reference in their entirety, Murphy (U.S. Pat. No. 5,048,822), Lee et al (U.S. Pat. No. 5,844,240) and Franey (U.S. Pat. No. 5,803,877).

FIELD OF THE INVENTION

The present invention relates to the field of boxing, and in particular to an apparatus and method for simulating a sparring partner during boxing training.

DESCRIPTION OF THE RELATED ART

Various devices are known for aiding in the training and exercising of boxers. These include the well-known heavy punching bag, the smaller floor-mounted or ceiling-mounted punching bags, sparring body opponents, boxing pears and others. Unfortunately, boxing is a game of movement, and most prior devices (including both patented and not) have included few if any realistic simulation of an opponent's movement.

Prior patented devices include Stephen U.S. Pat. No. 5,503,606, which describes a circular device moving the punching device around. Murphy U.S. Pat. No. 5,048,822 which teaches a device on a predictable track, and Moody U.S. Pat. No. 5,224,912 which teaches a linear device moving a punching bag back and forth.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect, the invention is about an apparatus for training a boxer comprising a raised support track defining a three dimensional non-linear path with variations in height over the datum, one or more carriages suspended from said support track, so that a training article suspended from it will be at an initial height suitable for optimal training interaction with a trainee, and such that movement by the carriage along the track causes horizontal and vertical movements of the training article with respect to the trainee, and drive means for moving the carriage along the track and hence effect horizontal and vertical movement of the target article, said drive means being controllable by a separate control system to simulate the varying movements of a sparring partner.

In another aspect, the track is an endless path, a chain extends the full length of said track, the carriage connected to the chain moves therewith, and said carriage includes low friction means engaging and resting on one or more surfaces of the track for movement therealong, the drive means being a motor driving said chain. In another aspect, the track is a channel having one or more horizontal support surfaces, the low friction means comprised rollers which roll on the horizontal support surface, the chain is supported in a plane above said track, the track has one or more openings along the complete length thereof for passage therethrough of a connection of the carriage to the chain.

In one aspect, a rotating hinge mounted to said carriage in order to allow for the free rotation of the training article as it interacts with the trainee. In another aspect, the carriage is equipped with motion sensors capable of detecting the position of the trainee and adjusting its motion in response to it. In yet another aspect, the track is an endless path that contains an electric power transfer channel along its entire length, and said carriage is connected to said power transfer channel and contains one or more electric motors under the control of said motion system.

In one aspect, a rotating hinge mounted to said carriage in order to allow for the free rotation of the training article as it interacts with the trainee. In another aspect the carriage is equipped with motion sensors capable of detecting the position of the trainee and adjusting its motion in response to it.

In one aspect, the invention is about a method of training a boxer by artificially simulating a sparring partner, said method comprising the steps of suspending a target article in the path of the boxer at a height to be punched by the boxer, utilizing control means to cause the target article to move horizontally and vertically along a predetermined non-linear path, including changing the speed and direction of the target article, to thereby cause the target article to move in a manner which simulates a sparring partner. In another aspect, the method includes preprogramming the control means to provide selected movements of the target article and effecting movements by said programs. In one aspect, the method includes moving the target article along the path forwardly and rearwardly and at varying speeds.

Other features and advantages of the present invention will become apparent upon examining the following detailed description of an embodiment thereof, taken in conjunction with the attached drawings.

BRIEF DESCRIPTION OF THE DRAWINGS

FIGS. 3A and 3B show illustrations of the top view and side view of certain track portions, according to exemplary embodiments of the invention.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Figure 1:
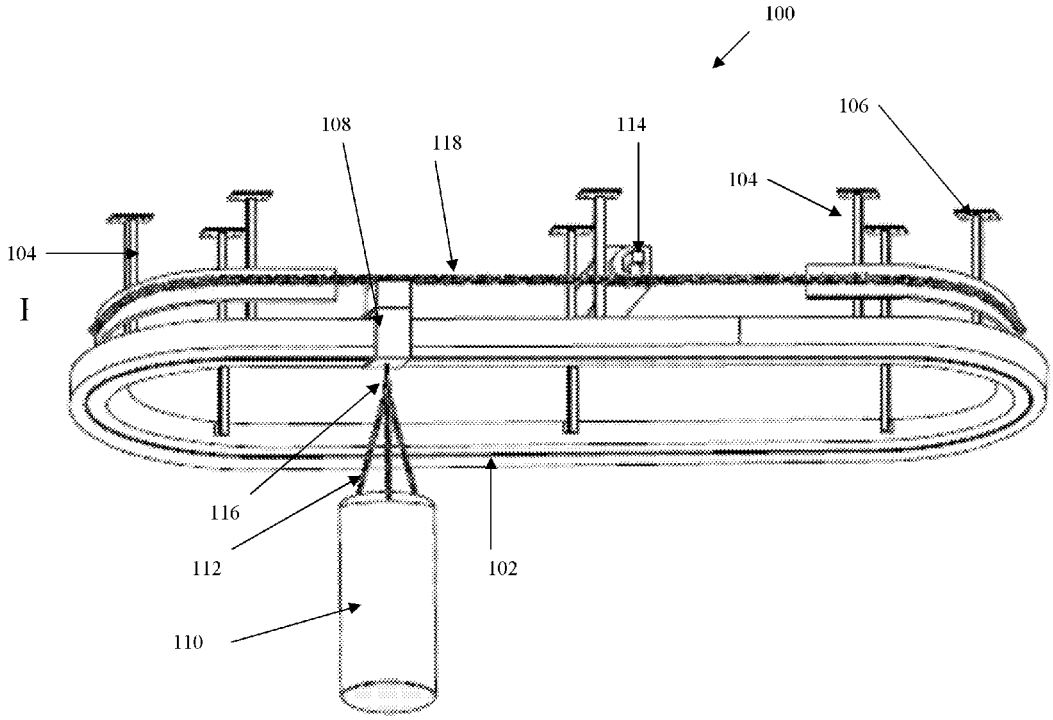
FIG. 1 shows an illustration of a ceiling mounted boxing training system rack, according to an exemplary embodiment of the invention.

Referring to FIG. 1 the boxing training system 100 includes a track 102 suspended from a ceiling (or any other high, sturdy support, or alternatively off a frame standing from the floor) by a series of support rigid metal bars 104 bolted through bolt-holes 106 onto the ceiling or other such mounts. The track 102 shown may be embodied as a monorail, an I-Beam, H-Beam, inverted C beam or any of a number of comparable rail tracks used for hanging rolling stock.

With such a track, a trainee (be it a boxer, a UFC fighter, a kick-boxer, martial arts enthusiast or any such person interested in the cardiovascular advantages of punching and moving) is capable of replicating the experience of boxing against a human being.

Figure 10:
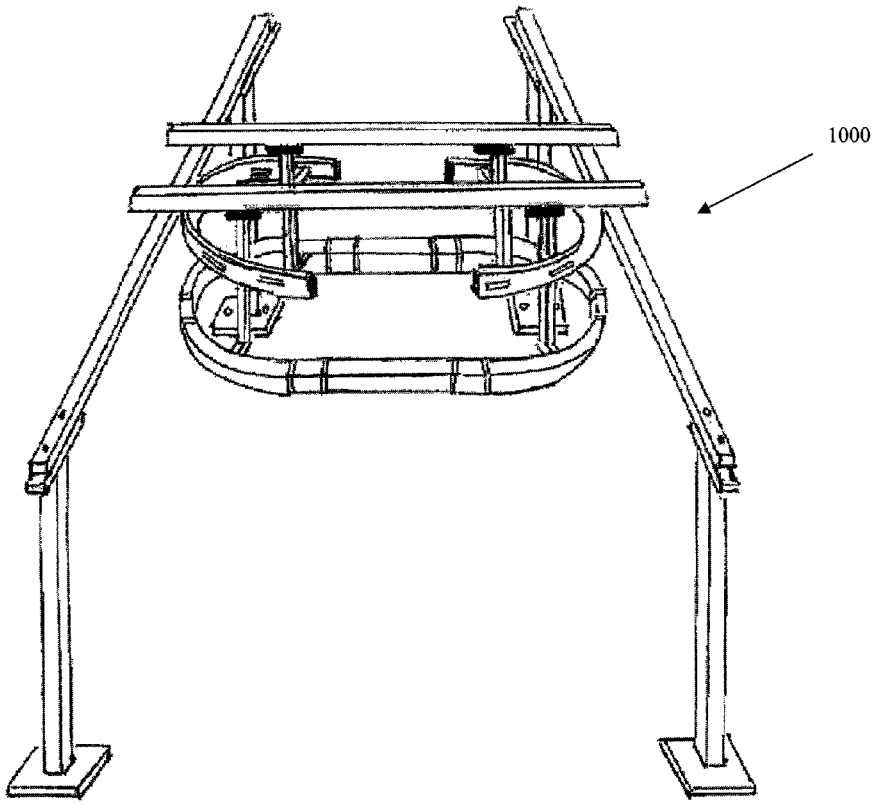
FIG. 10 shows an illustration of the track suspended from a sturdy support structure, according to an exemplary embodiment of the invention.

In an alternate embodiment FIG. 10, the track may be suspended from a sturdy support structure 1000 having a plurality of legs. In one embodiment, the track 102 (which may be constructed of iron, aluminum, plastic, carbon composites or steel) includes an interior channel and forms a generally elongated or circular loop.

Figure 12A:
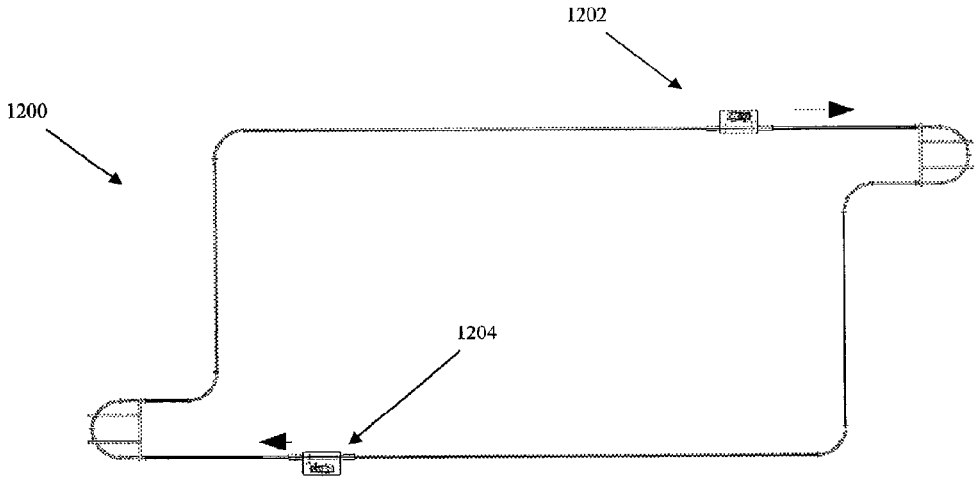
FIGS. 12A-12C show systems using a system similar to the PAC-LINE™ (Model C-250) Enclosed Track, according to exemplary embodiments of the invention.
Figure 12B:
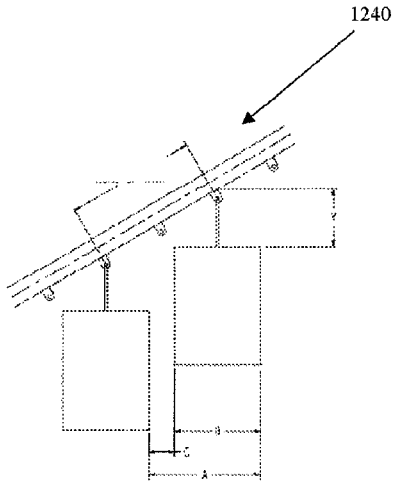
Figure 12C:
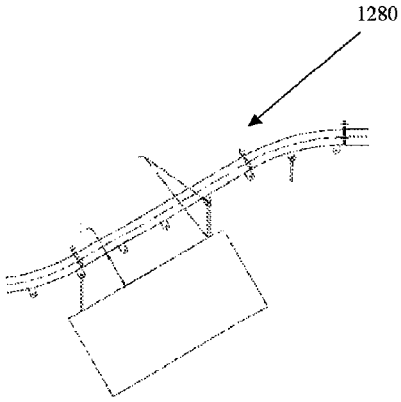

An excellent choice for the track is an enclosed monorail conveyor, similar to those found at Dry Cleaning shops. In such an embodiment FIGS. 12A-12C, the track 1200 may use a system similar to the PAC-LINE™ (Model C-250) Enclosed Track Overhead Conveyor or similar track. One 1202 or more motors 1202, 1204 are used to pull a train of linked hooks within the monorail. One particular advantage offered by such a system is the ability to climb or descend in height 1240, 1280 in a relative short distance while carrying a load hooked to one or two links.

The track is designed to allow for the movement of one or more carriages 108. In one embodiment, the carriages are powered by a central motor 114 through a chain 118. In alternate embodiments, each carriage is powered by an independent motor, with power to said motor being transferred from electrical contacts made with electrical power channels along the tract. Said power may be DC or AC.

Depending on the skill being practiced, a number of devices may be attached to the carriage 108. As seen in FIG. 1, the training article moved in relation to the trainee may be a punching bag 110, suspended via simple ropes or cables 112 from a central hook. Other embodiments will discuss other training articles below.

Figure 2:
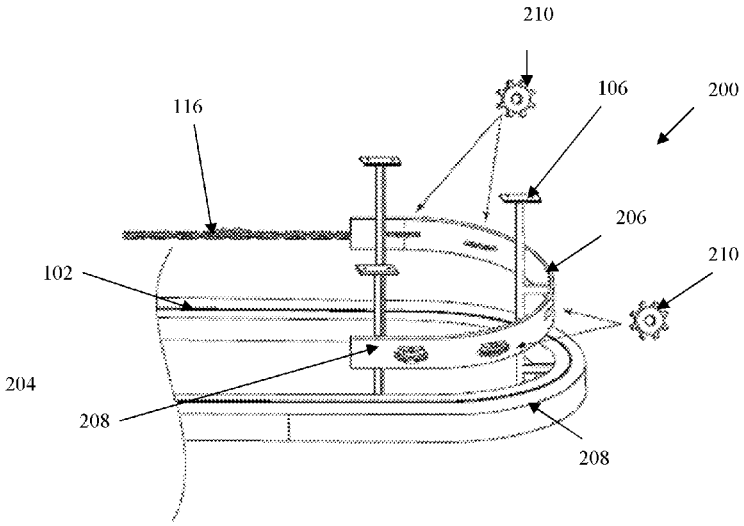
FIG. 2 shows an illustration of a close up and details of track components, according to an exemplary embodiment of the invention.

FIG. 2 illustrates details of one embodiment 200 of the track 102 and carriage 108. In it, we see the bolts 202 used to secure the bolt-holes 106 to the ceiling and the joint bolts 204 used to connect the metals bars 104 supporting the track 102. In one embodiment, the track 102 is separate from the chain 118 used to propel the carriage 108 along it. At regular intervals along its path, the chain 118 is assisted in making the corner or bend 206 above the track 102. In one embodiment, the chain 118 is made to travel between sprockets 210 mounted on the guardrail 208 which parallels the shape of the track 102 below.

FIGS. 3A and 3B illustrate significant improvements in making the track 102 more realistic in training a boxer. The top view of the track overall shape 300 as seen from above allows for the training device mounted in the carriage to move side to side (as would a real human) in both a fast fashion 302 and a slow fashion 304, as well as in a straight line 306. In addition to this, the side view 350 would also allow for the carriage to move up/down with reference to the datum 352 height. This change to the datum 352 would replicate the action/reaction of a boxer standing taller or "crunching" down.

Figure 4:
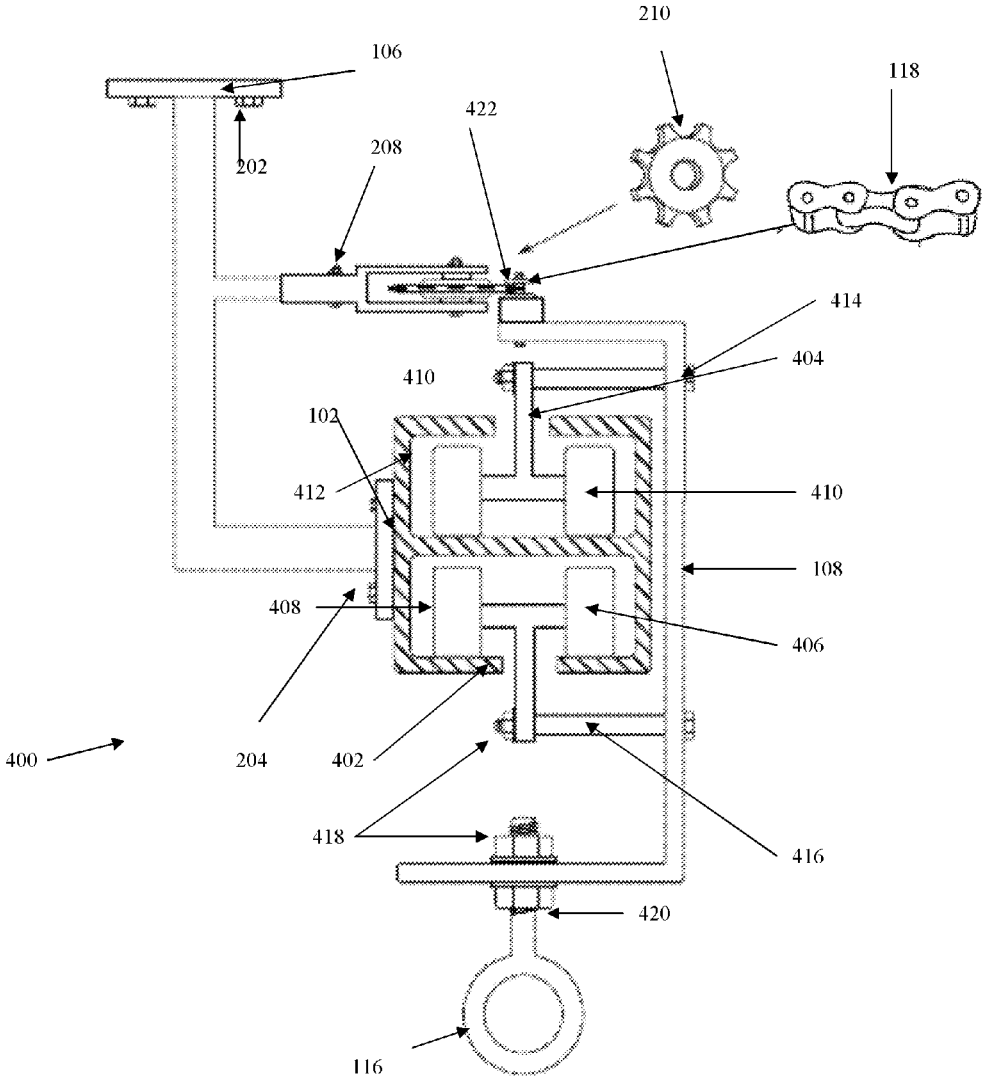
FIG. 4 shows an illustration of the cross section of the track, according to an exemplary embodiment of the invention.

In one embodiment, the cross-section 400 of the track 102, as shown in FIG. 4, is comprised of a rectangle with narrow openings or slots along the bottom 402 and top 404 of the rectangle. One or more carriages 108 are supported from the track 102 for conveyance along its perimeter. The carriage includes a set of rollers 406 which engages the lower interior 408 of the track 102, and an upper set of rollers 410 which engages the upper interior or chamber 412 of the track 102. Both of these sets of rollers (406, 410) are connected to carriage, in one embodiment via upper 414 and lower 416 bolts and nuts 418 form an outside frame which provides additional lateral support for the carriage 108.

One or more vertical supports 420 extend from the lower portion of the carriage 108, providing a mounting hoop or hook 116 that would be preferably located along the center of gravity of the carriage 108. Cords or ropes 112 for supporting a target article such as a punching bag 110 may then be suspended from it. In one embodiment, this is accomplished by any suitable means such as an "S"-shaped hook. The track 102 may be positioned at a height sufficiently high such that the center of the punching bag 110 is about one meter above the floor or ground at the datum height 352, although of course it could be adjusted to suit the boxer being trained. A chain 118 (such as a flat conveyor belt chain) is connected to the carriage top member 422 disposed above the channels (402, 404) in the track 102 and forms a closed loop spanning the entire length of the track 102. Movement of the chain 118 is imparted to the carriage 108.

Figure 5:
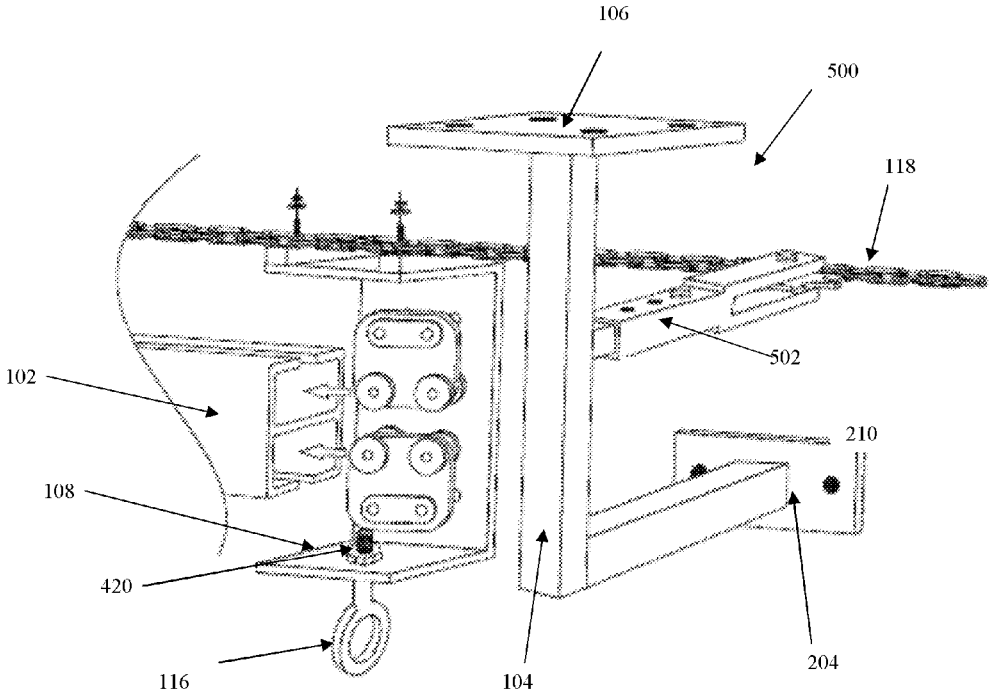
FIG. 5 shows the carriage travelling through the track, according to an exemplary embodiment of the invention.

FIG. 5 illustrates an embodiment of the carriage 108 traveling through the track 102. The rollers 406 may be made of a number of materials, including metals such as steel, iron, aluminum, as well as polymers, plastics and thermoplastics, including nylon, and aromatic and semi-aromatic advanced materials such as Primospire®, Torlon®, AvaSpire® and Amodel®. PrimoSpire is a polyphenylene (SRP) thermoplastic, Torlon® is a high performance amorphous (non-crystalline) engineering thermoplastic, a polyamide-imide (PAI).

AvaSpire® is a versatile family of polyaryletherketones (PAEK), PAEK is an advanced thermoplastic resin having both ether and ketone linkages in its chains. PAEK materials are semicrystalline aromatic polyesters with excellent mechanical and dielectric properties. Amodel® is a semi-aromatic polyamide (PPA) that delivers significantly higher performance than typical nylons. PPAs are a semi-crystalline, aromatic polyamide. Compared to nylon 6/6, it is stronger, stiffer, less sensitive to moisture, and has higher thermal capabilities. It has significant chemical fatigue and creep resistance.

The chain 118 driving the carriage 108 is kept on track via the regular implementation of sprockets 210 along its path. These sprockets 210 are mounted off side bars 502 that are mounted off the supports 104 that hold the track 102.

Figure 6A:
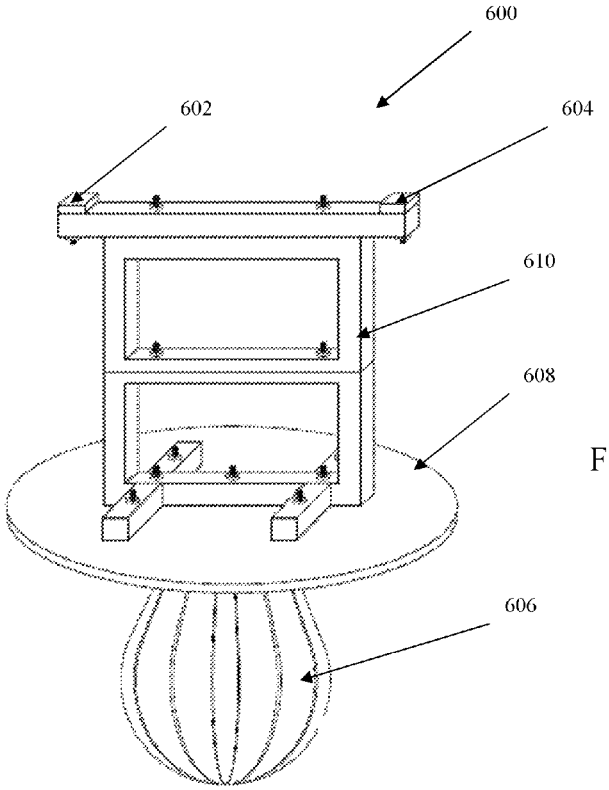
FIGS. 6A-6B show optional under carriage units, according to exemplary embodiments of the invention.
Figure 6B:
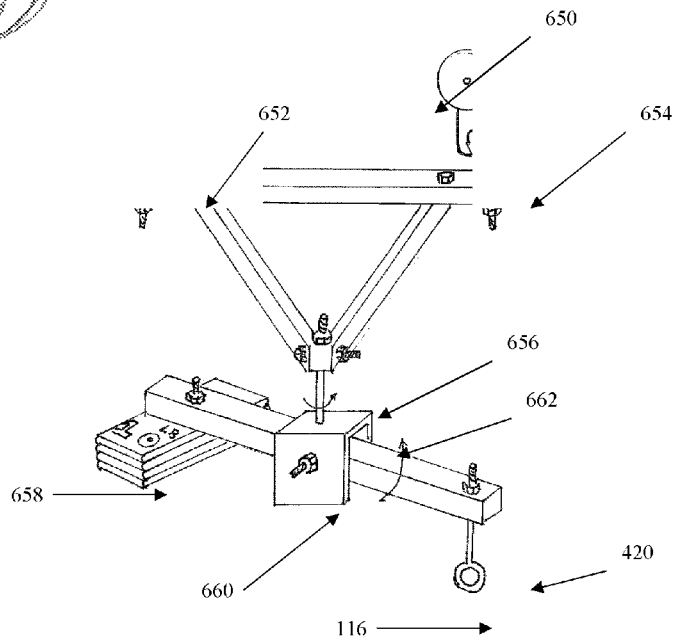

FIGS. 6A and 6B illustrate other exemplary embodiments of the under carriage 600, 650. These under carriage units 600 and 650 are capable of being connected to two or more standard rail carriages units at attachment points 602, 604 that each connects to the vertical support bolt 420 point in the carriage 108. In this fashion, a stable platform for a pear 606 punching mount 608 is provided. The height of the pear 606 may be adjusted by the provision of one or more extender blocks 610.

In addition, an enhanced functionality punching bag mount 650 is also provided. With similar mounting or attachment points 652, 654 to the rail carriage 108. This provides a stable, height adjustable platform (through extension of the central bolt 656) or quick changes in the weighs 658. Changing them, provides for a hinging effect at the central hinge 660, moving the bolt 420 position up/down, and by definition the punch bag 110. Similarly, the addition of a rotating hinge 662 to the central bolt 656 provides for an additional rotation of the punching bag in response to the punches from the trainee.

Figure 7:
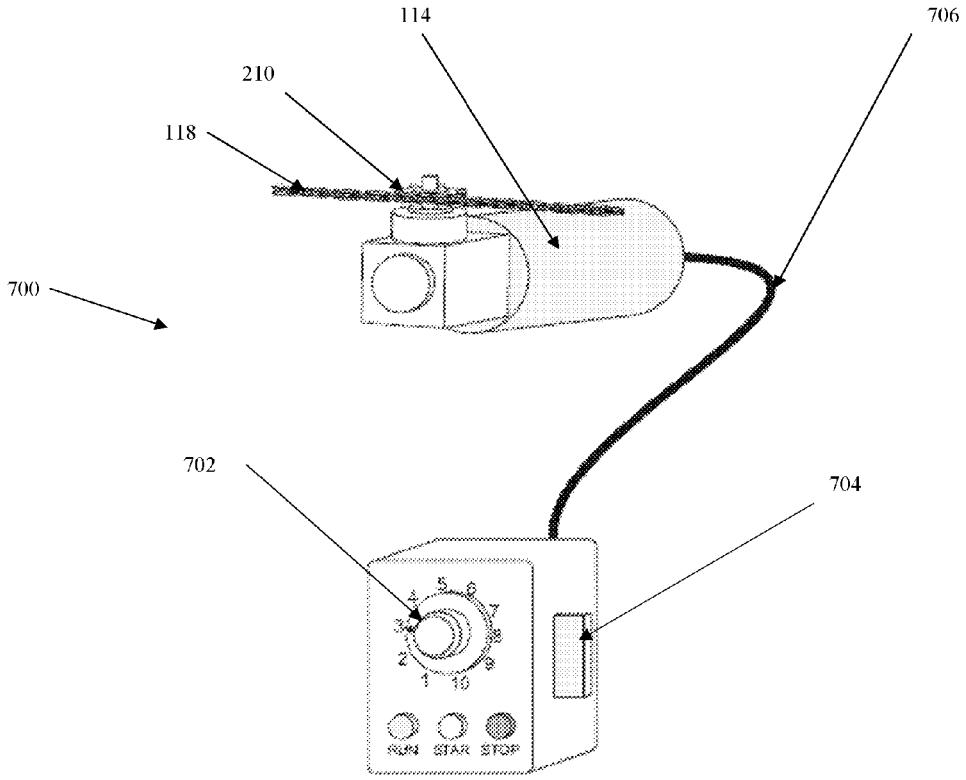
FIG. 7 shows a system control configuration, according to an exemplary embodiment of the invention.

FIG. 7 illustrates one possible system control configuration. In it, the motor 114 driving the sprocket 210 and thus the chain 118 is under the control of a simple electronic box 700 with Start, Stop and Run buttons. In one embodiment, a speed adjustment knob 702 allows a solo fighter, boxer or trainee to set a speed for training. In an alternate embodiment, the control is exercised by a set of preprogrammed instructions in a computer, which may be a Personal Computer, a tablet, a Smartphone, iPad, iPod or iPhone.

In addition, the box 700 may be equipped with a credit/debit or membership card magstripe reader 704 in order to limit its use, or record the identity of the person activating it. In an alternate embodiment, coin and dollar bills acceptance mechanisms (similar to those in vending machines) are connected. In an alternate embodiment, an additional lever or knob is provided so the trainee may program the timed duration of the session. Note that while there is a cable shown 706 between the controller 700 and the motor 114, this connection may be completely wireless, with both units being powered separately.

Figure 8:
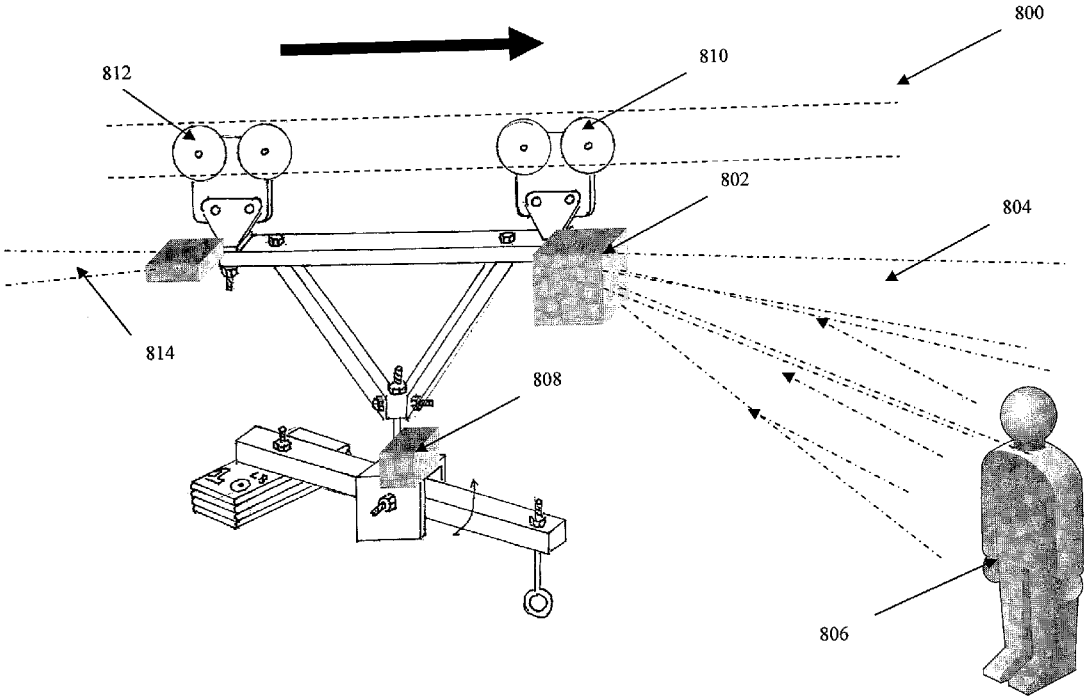
FIG. 8 shows an Infra-Red detector, according to an exemplary embodiment of the invention.

Referring to FIG. 8, in one embodiment, by providing an Infra-Red detector, such as that disclosed by Lee et al (U.S. Pat. No. 5,844,240), or other similar type of presence/motion sensor 802 mounted on the leading edge of the carriage 800 (be it a single mount or dual mount), it would be possible for the system to adjust its advance (or retreat) to/from the trainee 806 as a function of the trainee's motion. In this fashion, real-time control of the bag/pear would occur through sensing of the position 804 of the trainee. If the trainee decides to not move, the punching bag could simulate a boxer and stand "toe to toe" with the trainee, advance into him, or even retreat then advance.

In an alternate embodiment, the carriages motion is accomplished by motion means mounted on the carriage itself 812 and/or 810. These may be powered by the track, or contain self power, allowing them to be controlled independently. Again, control of these motors may be wired or wirelessly accomplished. A rear facing sensor 814 would ensure that the system would not "drive" into another trainee. Alternatively, the system could be networked with one or more other carriages on the same track, making the carriage aware of the vicinity of other carriages, and thus ensuring that two trainees don't collide. This can be easily accomplished through encoders in the tracks, or the addition of a barcode reader that reads the barcode in the track section it is in.

The addition of a vibration sensor at near the central bolt 420 would also provide an actuator 808 near the carriage with the ability to "sense" how the trainee is doing, and either advance or retreat. Similarly, the addition of an actuator (such as a Reell's® electric wrap spring clutch) would allow the system to restrict the level of rotation in combination with the training profile, allowing the freedom of rotation on the hinge 662 to be reduced or even eliminated. This, in combination with a rotation sensor (or not), would allow the system to "stop" retreating and advance.

Figure 9:
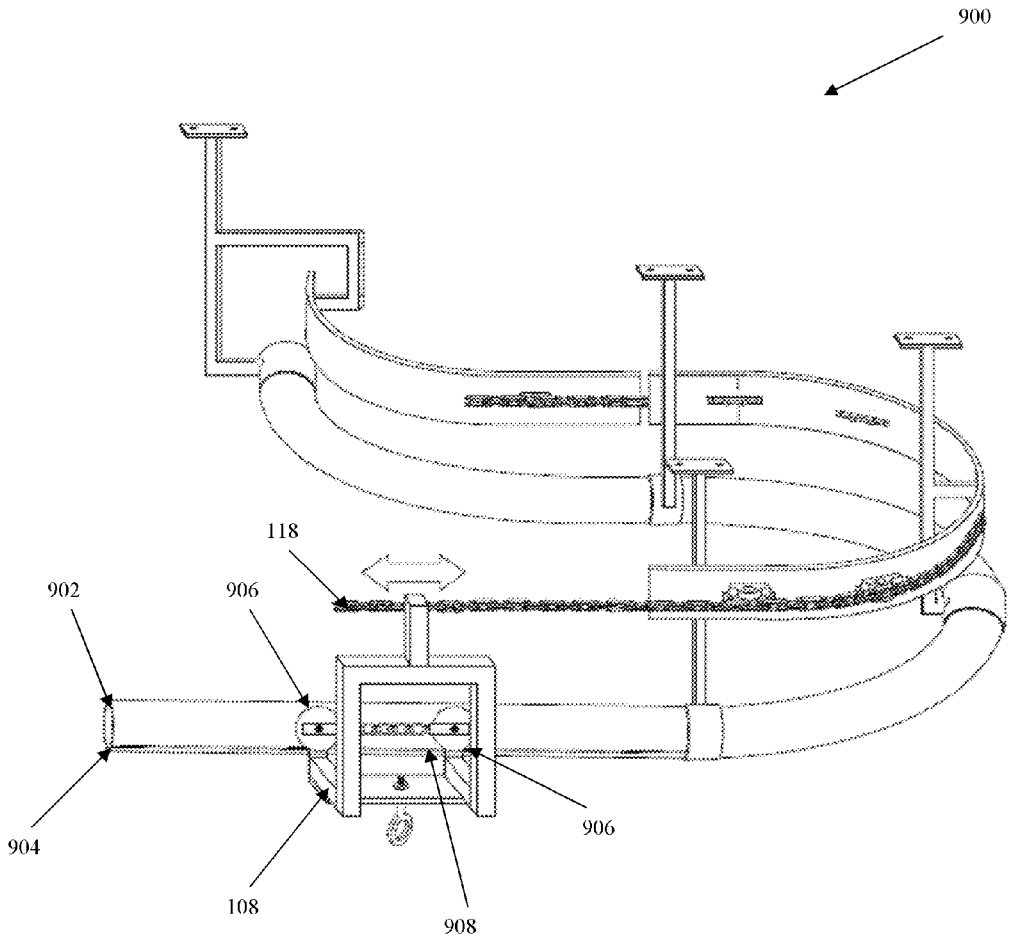
FIG. 9 shows an illustration of the system having a circular rail, according to an exemplary embodiment of the invention.

Referring to FIG. 9, in one embodiment the system 900 is implemented via a circular rail 902 having a lengthwise slit 904 along its bottom to allow for the movement along its length of a carriage 108 on which the punching bag 110 or other training implement is suspended. The carriage 108 slides along the inside of the rail 902 mounted on one or more wheels 906 that are coupled together by a cable or chain 908. In one embodiment, the carriage 108 is moved by being attached to a chain 118 that is moved around the periphery of the track 902 by a motor 114. In an alternate embodiment, the carriage is self-powered by having a motor mounted on the wheels 906 and power is transferred to them via a dual powered rail assembly. In an alternate embodiment, the carriage 108 or wheels 906 have energy storage means (e.g. batteries) mounted on them.

Figure 11:
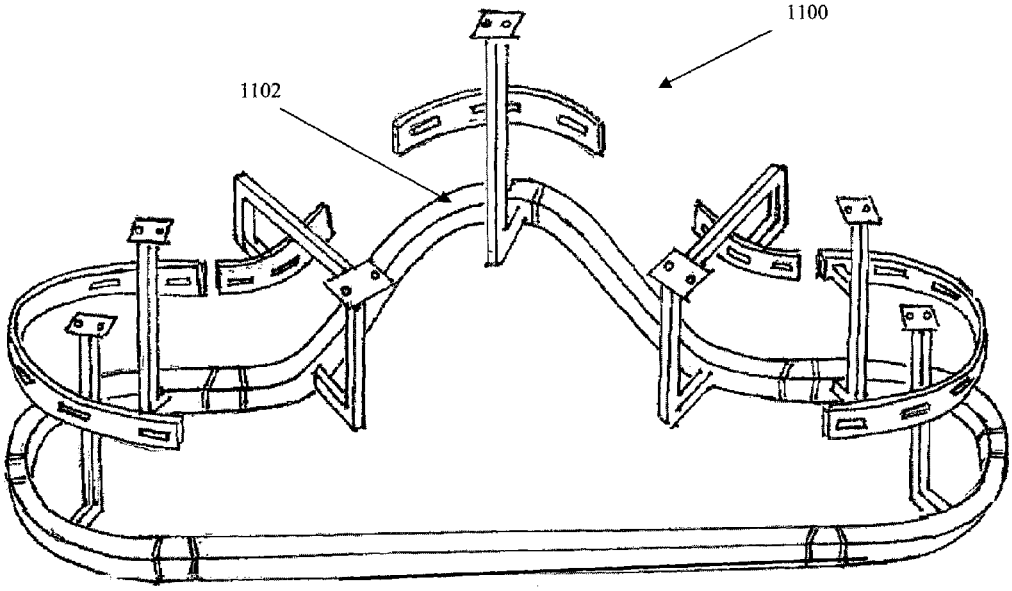
FIG. 11 shows an illustration of a system with a multi-plane path (horizontal and vertical variations of the track, according to an exemplary embodiment of the invention.

An alternate embodiment of the invention is seen in FIG. 11 where a system 1100 with a multi-plane path 1102 (horizontal and vertical variations) is embodied. Such a system may have a carriage 108 that is powered by chain 908 or through self-powered carriages with or without power means.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. An apparatus for training a boxer comprising:

a raised support endless path continuous length track defining a three dimensional non-linear path with variations in both location and height over a ground surface, a carriage suspended from said support track, so that a training article suspended from said carriage will be at an initial height suitable for optimal training interaction with a trainee, and such that movement by the carriage along the track causes horizontal and vertical movements of the training article with respect to the trainee;

a motor driving a chain for moving the carriage along the track and hence effect horizontal and vertical movement of the training article, said motor being controllable by a control system to simulate varying movements of a sparring partner;

wherein said track is an endless path with a channel having one or more horizontal support surfaces, said chain extending the full length of said track and is supported in a plane above said track, the carriage connected to the chain moves therewith, and said carriage includes one or more rollers engaging and resting on said one or more horizontal support surfaces of the track for movement there along;

wherein a rotating hinge mounted to said carriage allows for a free rotation of the training article said training article adapted to interact with the trainee and an electric wrap spring clutch controls the free rotation of said training article in both a horizontal direction and a vertical direction below said carriage.

2. The apparatus of claim 1 wherein;

the carriage is equipped with motion sensors capable of detecting the position of the trainee and adjusting said carriage motion in response to the trainee.

3. The apparatus of claim 1 wherein;

the track is an endless path that contains an electric power transfer channel along its entire length; and said carriage is connected to a power transfer channel and contains one or more electric motors under the control of a motion system.

* * * * *